US006382988B1

(12) United States Patent
Rugg et al.

(10) Patent No.: US 6,382,988 B1
(45) Date of Patent: May 7, 2002

(54) ENCIRCLED ELECTRICAL COMPRESSION CONTACT

(75) Inventors: William Rugg, Berthoud, CO (US); Seah Ke Hor, Singapore (SG)

(73) Assignee: Ranoda Electronics PTE Ltd., Singapore (SG)

( * ) Notice: Subject to any disclaimer, the term of this patent is extended or adjusted under 35 U.S.C. 154(b) by 0 days.

(21) Appl. No.: 09/109,589

(22) Filed: Jul. 2, 1998

(51) Int. Cl.[7] ..... H01R 12/00

(52) U.S. Cl. ..... 439/82; 439/78; 439/876; 361/413

(58) Field of Search ..... 439/82, 80, 78, 439/876, 83; 361/413

(56) References Cited

U.S. PATENT DOCUMENTS 4,186,982 A * 2/1980 Cobaugh et al. ..... 339/17

4,446,505 A * 5/1984 Long et al. ..... 361/413

* cited by examiner

*Primary Examiner*—P. Austin Bradley
*Assistant Examiner*—Truc Nguyen
(74) *Attorney, Agent, or Firm*—Harness, Dickey & Pierce, P.L.C.

(57) ABSTRACT

A compression contact (13) for use with a complementary cylindrical contact (11), has a pair of opposed contact faces (12) on respective contact body portions. The contact faces (12) are compressible inwardly, transverse to the longitudinal axis of the compression contact (13), as the compression contact (13) is inserted into the cylindrical contact (11); and the contact faces (12) are resiliently expansible outwardly to form an electrical contact with the contact face within the cylindrical contact (11).

12 Claims, 3 Drawing Sheets

ENCIRCLED ELECTRICAL COMPRESSION CONTACT

BACKGROUND OF THE INVENTION (1) Field of the Invention

This invention relates to an encircled electrical compression contact.

The present invention is particularly suitable for, but not limited to, a contact adapted to co-operate with a complementary cylindrical contact to enable electrical continuity between two mating electronic assemblies. Such assemblies include planar electronic printed circuit board assemblies, flexible connectors and circuit cables used in the computer and telecommunications industries, eg., in disk drives or wireless phone apparatus.

(2) Prior Art

Electrical contacts are commonly used to electrically interface two circuit boards or similar substrates, or a circuit board to a circuit cable. Such contacts commonly incorporate an insulated connector body, where an electrically-conductive path extends through the body from a terminal at one face (connected by a soldering process to a second printed circuit board or to a conductive wire or lead in a cable) to a conductive metal contact, extending from the opposite face, releasably engageable in a complementary cylindrical contact or like conductive device (eg., in the substrate of a printed circuit board).

The metal contact is encircled in the cylindrical contact and is compressed thereby. This type of encircled compression contact is particularly useful for joining noise sensitive circuits with the minimal length of electrically conductive path between the two circuits.

In applications such as in disk drives or wireless phone apparatus, it is often desirable to provide electrical continuity between a flexible printed circuit board cable and a rigid printed circuit board. In such applications, all the forces on the compression contact are applied along the longitudinal axis of the contact to the surface of the rigid printed circuit board. The electrical connection is then generated by the longitudinal force applied by the compression contact to the terminal pads, leads or similar conductive attachments on a printed wiring board.

A connector can include any number of compression contacts or pins, typically twenty (20) or more. The strong longitudinal loads applied by all the compression contacts can create soldered joint fatigue on the components directly aligned with or adjacent the printed circuit board. The containment, or control, of such forces is difficult and can be expensive, especially as the number of compression contacts on a printed circuit board, or in a cable connector, increases, thereby compromising the reliability of the electrical compactor between the two electronic components.

SUMMARY OF THE PRESENT INVENTION

It is an object of the present invention to provide an encircled compression contact where the longitudinal forces are minimised.

It is a preferred object of the invention to provide such a contact where the compression forces are substantially transverse to the longitudinal axis of the contact.

It is a further preferred object to provide such a contact which can be easily inserted in, and accurately located relative to, the cylindrical (encircling) contact.

It is a still further preferred object to provide such contacts which can be easily fabricated and incorporated into moulded insulated housings or connector bodies at a high volume rate.

It is a still further preferred object to provide an electronic component (eg., circuit board or cable connector) incorporating one or more of the contacts.

Other preferred objects will become apparent from the following description.

In one aspect, the present invention resides in an encircled compression contact for an electrical component, the compression contact being formed of electrically conductive material, the compression contact including:

- a bottom portion, receivable in an electrically insulating support and connectable to an electrical circuit;
- a top portion, spaced from the bottom portion, configured for insertion into an encircling contact; and
- a pair of body portions interconnecting the top and bottom portions and having opposed contact faces, so arranged that when the compression contact is inserted into the encircling contact, the compression forces are transverse to a longitudinal axis of the compression contact and urge the contact faces into electrical contact with the encircling contact.

Preferably, the bottom portion extends between opposed surfaces of the insulating support and creates the compression forces for the contact faces.

Preferably, the top portion is configured for insertion into the encircling contact and has a bottom wall engageable with an end face of the encircling contact.

Preferably, each contact face has a shoulder, spaced from the bottom wall of the top portion, engageable with an opposed end face of the encircling contact.

Preferably, the body portions are substantially planar and are offset so that, when the contact faces are compressed inwardly as the compression contact is inserted into the encircling contact, adjacent faces of the body portions slide over each other.

Preferably, the compression contact is formed from a single strip of electrically conductive material selected from stainless steel, cooper or phosphorous bronze.

In a second aspect, the present invention resides in an encircled electrical compression contact assembly including:

- a compression assembly as hereinbefore described; and
- an encircling contact, formed of electrically conductive material, the encircling contact having a cylindrical body, with an internal contact face engageable with the contact faces of the compression contact, the cylindrical body extending between opposed surfaces of a rigid supporting substrate.

In a third aspect, the present invention resides in an electrical connector or component having:

- a body or support of electrically insulating material; and
- at least one of the compression contacts as hereinbefore described, the bottom portion of the or each compression contact being received in the body or support.

BRIEF DESCRIPTION OF THE DRAWINGS

To enable the invention to be fully understood, preferred embodiments will now be described with reference to the accompanying drawings, in which.

DETAILED DESCRIPTION OF THE PREFERRED EMBODIMENTS

Figure 1:
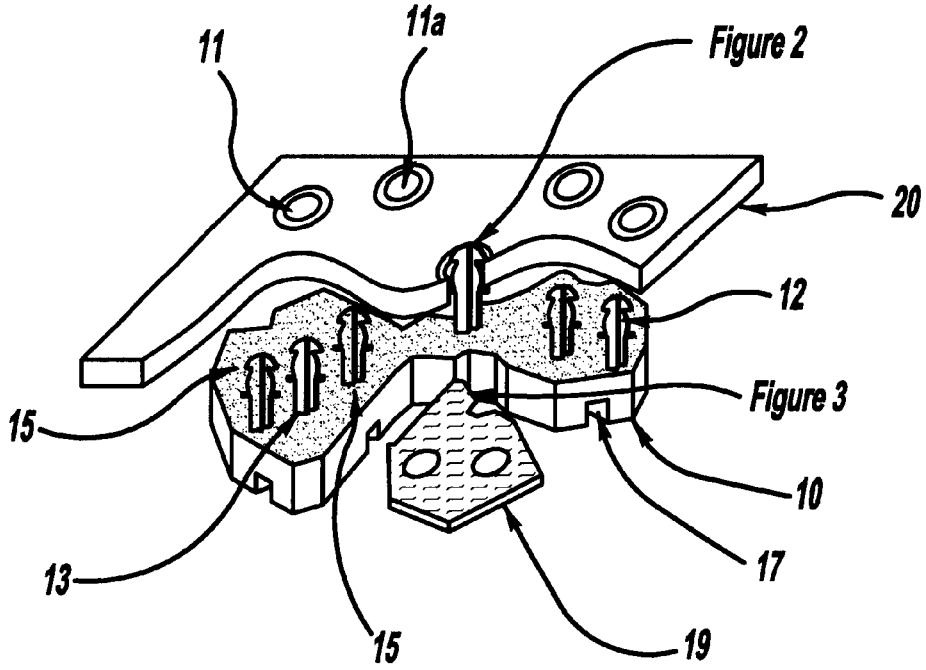
FIG. 1 is a perspective view illustrating the interconnection of electrical components by the contact of the present invention.

Referring to FIG. 1, the encircled compression connector 13, shown in more detail in FIGS. 2 to 5, is particularly useful in devices such as computer disk drives or wireless phone apparatus, where an electrical interface is required between two substrates, such as a printed circuit board and a printed circuit cable or flexible circuit.

The printed circuit board 20, formed with a plurality of electrically conducting paths on a rigid substrate of insulating material, has a plurality of cylindrical (encircling) contacts 11, which may be arranged in a non-linear configuration or array. The circuit board substrate 20 typically has a thickness T of 0.045" (or 1.14 mm) and the cylindrical contacts 11 each have a cylindrical internal contact face with a typical diameter D of 0.032" (or 0.08 mm).

The cylindrical contacts are known as the target site terminals for the corresponding encircled compression contacts to be hereinafter described in more detail.

A connector 10 is fabricated from an electrically insulative material, and in a preferred embodiment, is fabricated from a high-temperature thermoplastic material. A particularly suitable material is Liquid Crystal Polymer XYDAR930 from AMOCO Plastic Materials Inc., USA.

The compression contacts 13 project from the connector body 10 and are provided in a configuration or array complementary to the configuration or array of the cylindrical contacts 11 in the circuit board 20.

The compression contacts 13 are manufactured from highly conductive metal strip, typically 0.004" to 0.020" (0.10 to 0.5 mm) thick; suitable contact materials including stainless steel, copper pr phosphorous bronze type metals.

The contact surfaces and mating surface finish materials are matched for performance and are designed to provide the highest electrical path continuity with the lowest possible electrical resistance. The compression contacts 13 are designed to operate with industry standard gold, tin/lead, copper, palladium and silver metal finishes for rigid substrates.

Figure 6:
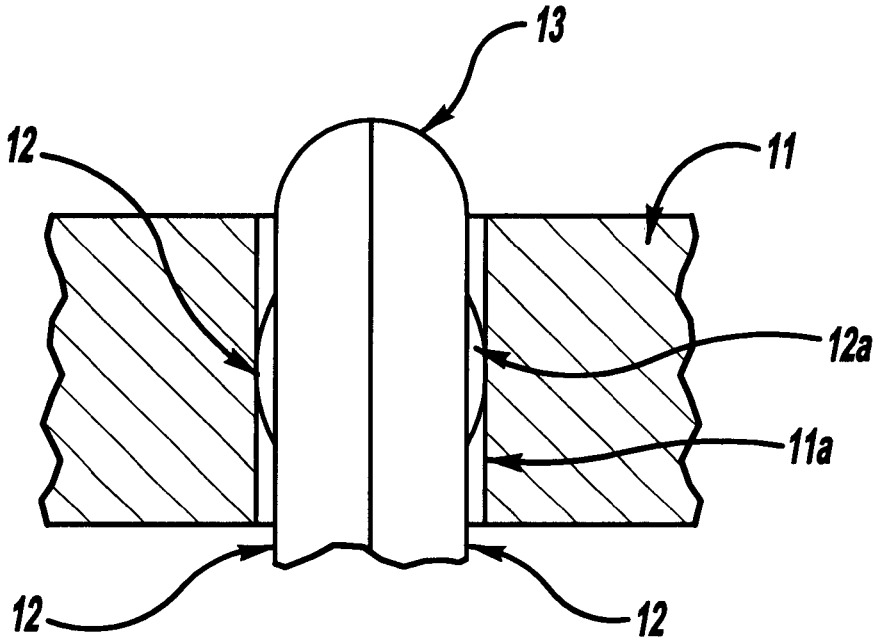
FIG. 6 illustrates an alternative embodiment of the contact.

Each compression contact 13 has a pair of opposed contact surfaces 12 arranged to interface with the contact face 11*a* in its complementary cylindrical contact 11. While the contact faces 12 may be planar, it is preferred that they be conversely curved, see FIGS. 2 and 4; or that they have outward protrusions 12*a;* see FIG. 6, to ensure good electrical contact (and continuity) with the (plain cylindrical) contact face 11*a* in the cylindrical contact 11, even if the longitudinal axes of the contacts 11, 13 are not aligned.

Figure 2:
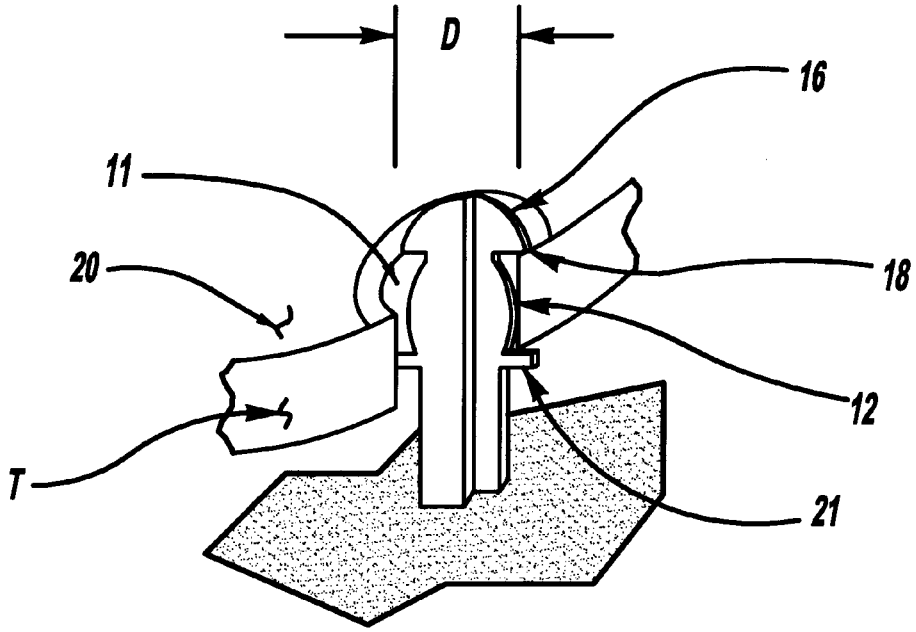
FIG. 2 is an enlarged view of one of the contacts in FIG. 1.
Figure 3:
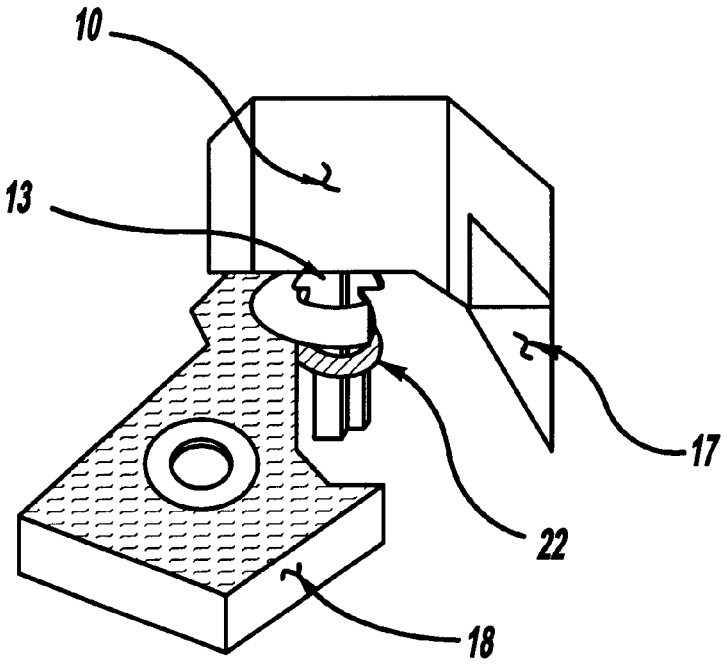
FIG. 3 is a perspective view showing the attachment of one of the contacts to a printed wiring cable.
Figure 4:
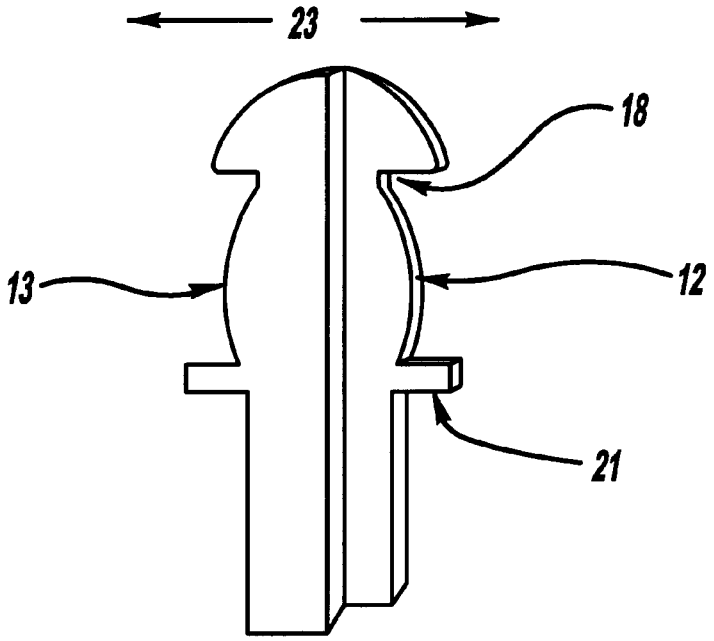
FIG. 4 illustrates the forces applied to the encircled contact.

As shown in more detail in FIGS. 2 to 4, each compression contact 13 is fabricated from a single metallic piece for the continuity of the circuit soldered to a flexible substrate. A pair of contact body portions are offset so that when the respective opposed contact faces 12 are compressed inwardly (ie., transversely to the longitudinal axis of the contact 13), the adjacent faces of the body portions will slide over each other. The resilience of the metal urges the contact faces 12 outwardly against the contact face 11*a* in the cylindrical contact 11.

The top portion 16 of the compression contact 13 is curved or tapered to assist the longitudinal insertion of the compression contact 13 into its complementary cylindrical contact 11, and a bottom face 18 on the top portion 16 is adapted to engage the annular end face of the cylindrical contact 11 (and/or the printed circuit board 20) on insertion. A shoulder 21 (below each contact face 12) is adapted to receive, support and make contact with the adjacent annular end face of the cylindrical contact 11 and controls the depth (or extent) of insertion of the compression contact 13 into its complementary cylindrical contact 11. The location of the shoulders on the compression contact 13 can be varied to accommodate any of the desired rigid substrate thicknesses typically used in disk drives or wireless phone apparatus in the computer industry. (in a modified embodiment, not illustrated, the shoulders 21 may be omitted.)

Figure 5:
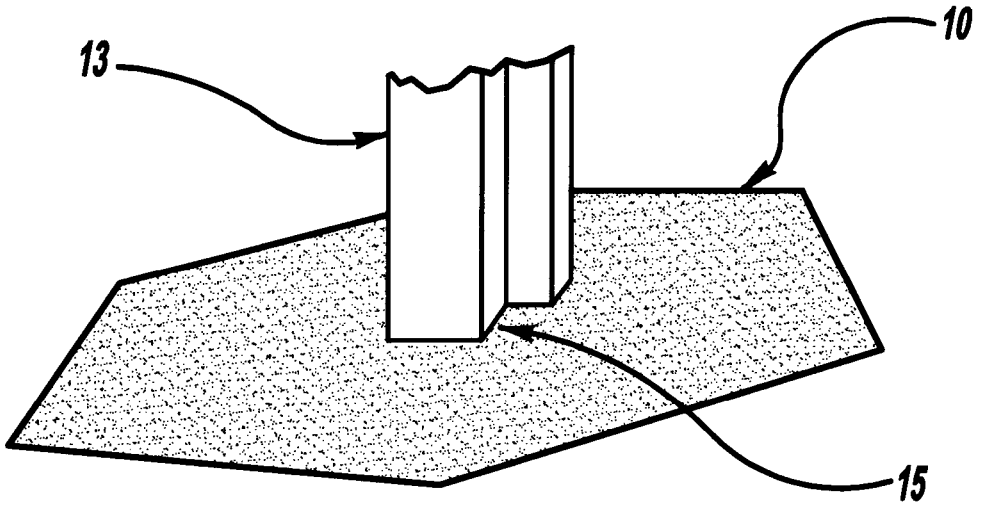
FIG. 5 illustrates the mounting of the contact on an electrical connector.

The bottom portion 15 of the compression contact 13, see FIGS. 1 and 5, positions the contact in the insulated connector body 10 to produce the necessary forces between the contact faces in the contacts 11, 13 to ensure an industry standard reliable connection. As shown in more detail in FIG. 5, the stationary point of contact containment creates a starting point for the lateral forces on the contact body portions to maintain the contact faces 12 to contact with the contact face in the cylindrical contact 11. The bottom portion 15 of the contact 13 is heretically sealed to the connector body 10 to prevent the ingress of contamination into the internal disk drive environment. Such sealing is important in such an application to protect the sensitive disk operating environment.

FIG. 3 illustrates the attachment of the flexible cable 19 to the connector body 10, and the self-cleaning features of the connector body. The connector body 10 has a smooth surface separated by channels 17. The interconnected channels 17 in the moulded connector body 10 are designed to accommodate the cleaning process after the soldering operation, where solder 22 connects the bottom portions 15 of the compression contacts 13 to the printed wiring cable 19 or other electrical substrate in a hermetically sealed manner.

As shown in FIG. 4, the mating forces between the contact faces 12 on the compression contact 13, when inserted in its complementary cylindrical contact 11, are transverse to the longitudinal axis of the contact 13, ie., in the direction of arrow 23. (The resilience of the metal forming the contact opposes any inward deflection of the body portions 16 by the cylindrical contact 11.) These forces maintain the contact, and thereby electrical continuity, between the contact faces 12 and the contact face in the cylindrical contact 11 at the terminal or connection site. This ensures reliability of electrical contact with a simpler, less expensive encircled compression contact than is possible with conventional longitudinal compression style contacts, which rely on longitudinal insertion forces to maintain the electrical contact and continuity.

Various changes and modifications may be made to the embodiments described and illustrated without departing from the present invention.

What is claimed is:

1. An encircled compression contact for an electrical component, the compression contact being formed of electrically conductive material and being configured for insertion into an encircling electrical contact having first and second adjacent annular end faces, the compression contact including:

a bottom portion, receivable in an electrically insulating support and connectable to an electrical circuit;

a top portion, spaced from the bottom portion, configured for insertion into the encircling contact, said top portion including a bottom face adapted to engage said first adjacent annular end face of said encircling electrical contact; and a pair of offset body portions interconnecting the top and bottom portions and having opposed contact faces, so arranged that when the compression contact is inserted into the encircling contact, the compression forces are transverse to a longitudinal axis of the compression contact and urge the contact faces into electrical contact with the encircling contact; and a shoulder below each opposed contact face being adapted to receive, support, and make contact with said second adjacent annular end face of said encircling electrical contact, said shoulder being spaced apart from and in opposition to said bottom face of said top portion, thereby substantially capturing said encircling electrical contact.

2. A compression contact as claimed in claim 1, wherein:

the bottom portion extends between opposed surfaces of the insulating support or creates the compression forces for the contact faces.

3. A compression contact as claimed in claim 1, wherein:

the top portion is configured for insertion into the encircling contact and has a bottom wall engageable with an end face of the encircling contact.

4. A compression contact as claimed in claim 3 wherein:

each contact face has a shoulder, spaced from the bottom wall on the top portion, engageable with an opposed end face of the encircling contact.

5. A compression contact as claimed in claim 1, wherein:

the contact faces are planar, conversely-curved and/or have outwardly-directed protrusions, the curved faces or protrusions ensuring electrical continuity between the compression contact and the encircling contact when their respective longitudinal axes are not aligned.

6. A compression contact as claimed in claim 1, wherein:

the compression contact is formed from a single strip of electronically conductive material selected from stainless steel, copper or phosphorous bronze.

7. An encircled electrical compression contact assembly including:

a compression contact as claimed in claim 1; and an encircling contact, formed of electrically conductive material, the encircling contact having a cylindrical body, with an internal contact face engageable with the contact faces of the compression contact, the cylindrical body extending between opposed surfaces of a rigid supporting substrate.

8. An electrical connector or component having:

a body or support of electrically insulting material; and at least one of the compression contacts as claimed in claim 1, the bottom portion of the or each compression contact being received in the body or support.

9. A compression contact as claimed in claim 2, wherein:

the top portion is configured for insertion into the encircling contact and has a bottom wall engageable with an end face of the encircling contact.

10. A compression contact as claimed in claim 9 wherein:

each contact face has a shoulder, spaced from the bottom wall on the top portion, engageable with an opposed end face of the encircling contact.

11. A compression contact as claimed in claim 2, wherein:

the compression contact is formed from a single strip of electrically conductive material selected from the group consisting of stainless steel, copper or phosphorous bronze.

12. A compression contact as claimed in claim 3, wherein:

the compression contact is formed from a single strip of electrically conductive material selected from the group consisting of stainless steel, copper or phosphorous bronze.

* * * * *